United States Patent [19]

Garofalo

[11] 4,203,250

[45] May 20, 1980

[54] MOLDED MODEL AIRPLANE

[75] Inventor: Vito M. Garofalo, Chicago, Ill.

[73] Assignee: The Hi-Flier Manufacturing Company, Decatur, Ill.

[21] Appl. No.: 1,173

[22] Filed: Jan. 5, 1979

[51] Int. Cl.[2] ..... A63H 27/00

[52] U.S. Cl. ..... 46/79; 46/76 R

[58] Field of Search ..... 46/79, 80, 81, 76 R, 46/76 A, 77, 78; 244/16

[56] References Cited

U.S. PATENT DOCUMENTS

| | | | |
|---|---|---|---|
| 2,274,208 | 2/1942 | Mull | 46/81 |
| 2,664,666 | 1/1954 | Walker | 46/79 |
| 2,932,124 | 4/1960 | Robinette | 46/79 |
| 3,945,147 | 3/1976 | Crowder | 46/79 X |

OTHER PUBLICATIONS

Guillow's Biplane; Dawn Patrol; Paul K. Guillow, Inc., Wakefield, Mass.

Trophy Class Glider; Cambridge Toys, Inc., Minneapolis, Mn. 55420.

Chuck'R Glider, Pat. No. 2,739,414, North Pacific Products, Inc., Bend, Oregon, 97701.

Glider No. 5131, Testor Corp., Rockford, Ill. 61101.

*Primary Examiner*—Louis G. Mancene

*Assistant Examiner*—Mickey Yu

*Attorney, Agent, or Firm*—Kenway & Jenney

[57] ABSTRACT

A model airplane fuselage is molded of rigid foam so that a rudder-mount at the rear of the fuselage is made up of alternating projections defining a rudder slot, some of the projections being undercut for locking the rudder in place by engaging rudder projections. A slot for a wing is flared at the outer ends to allow wedges to be pressed beneath the wing to form a dihedral configuration.

8 Claims, 12 Drawing Figures

MOLDED MODEL AIRPLANE

BACKGROUND OF THE INVENTION

This invention relates to model airplanes, and particularly to model airplane fuselages molded of rigid foam.

From the manufacturer's point of view, a desirable model airplane is one that is easy to make, is sturdy, and is realistic enough to be attractive to the typical model airplane user. Model airplanes made from molded plastic foam satisfy these criteria and such planes are made. Modern molding techniques make many components easy to manufacture; the components are reasonably sturdy, and easy to repair if broken; and three-dimensional, realistic shapes can be formed with relative ease. Many other qualities of foam, such as its light weight and inexpensive nature, make it desirable for use for model airplanes. However, the advantages of foam for model airplane construction have not been fully utilized partially because some shapes that are desirable for model airplanes may require complicated molding techniques and apparatus.

For example, a typical model airplane is assembled by inserting a wing, a stabilizer, and a rudder into a fuselage. Usually, slots are provided in the fuselage for these components. However, the slots in the fuselage for the wing and stabilizer are horizontal whereas the slot for the rudder is vertical. Molding such differently-oriented slots simultaneously in the fuselage is difficult. To create slots in two directions would require costly side action camming devices. Moreover, cast aluminum molds are frequently used for expanded foam injection molding because of their desirable thermal characteristics. Side action devices are especially not desirable for aluminum molds—the wear factor from the required movement is too high.

Accordingly, it is an object of this invention to provide an attractive model airplane that can be produced from rigid plastic foam with simple injection molding techniques.

It is another object of the invention to provide a model airplane fuselage that can be molded from a simple draw mold, with the capability of receiving both horizontally and vertically inserted components.

Other objects of the invention will in part be obvious and will in part appear hereinafter.

SUMMARY OF THE INVENTION

A model airplane fuselage is formed so that a vertical rudder slot is created by a linear series of vertical projections rising from the rear top surface of the fuselage. The projections are in a non-overlapping arrangement as viewed from the side of the fuselage. The projections have vertical wall surfaces on opposite sides of the centerline of the rear top surface spaced from the centerline to define the rudder slot. Some of the projections have undercut portions for capturing edge projections of the rudder to lock it in place.

A wing slot extending horizontally through the fuselage, perpendicularly to the major axis, has an upper surface with two portions symmetrically inclining upward from the center of the slot. Blocks may be inserted under a wing seated in the slot to create a dihedral wing.

Fin-like projections extending along a major portion of the length of the fuselage at its top and bottom may, in a series mold, be connected to the corresponding projections of other fuselage bodies.

BRIEF DESCRIPTION OF THE DRAWINGS

For a fuller understanding of the nature and objects of the invention, reference should be made to the following detailed description and the accompanying drawings, in which.

DESCRIPTION OF THE PREFERRED EMBODIMENT

Figures 1, 2:
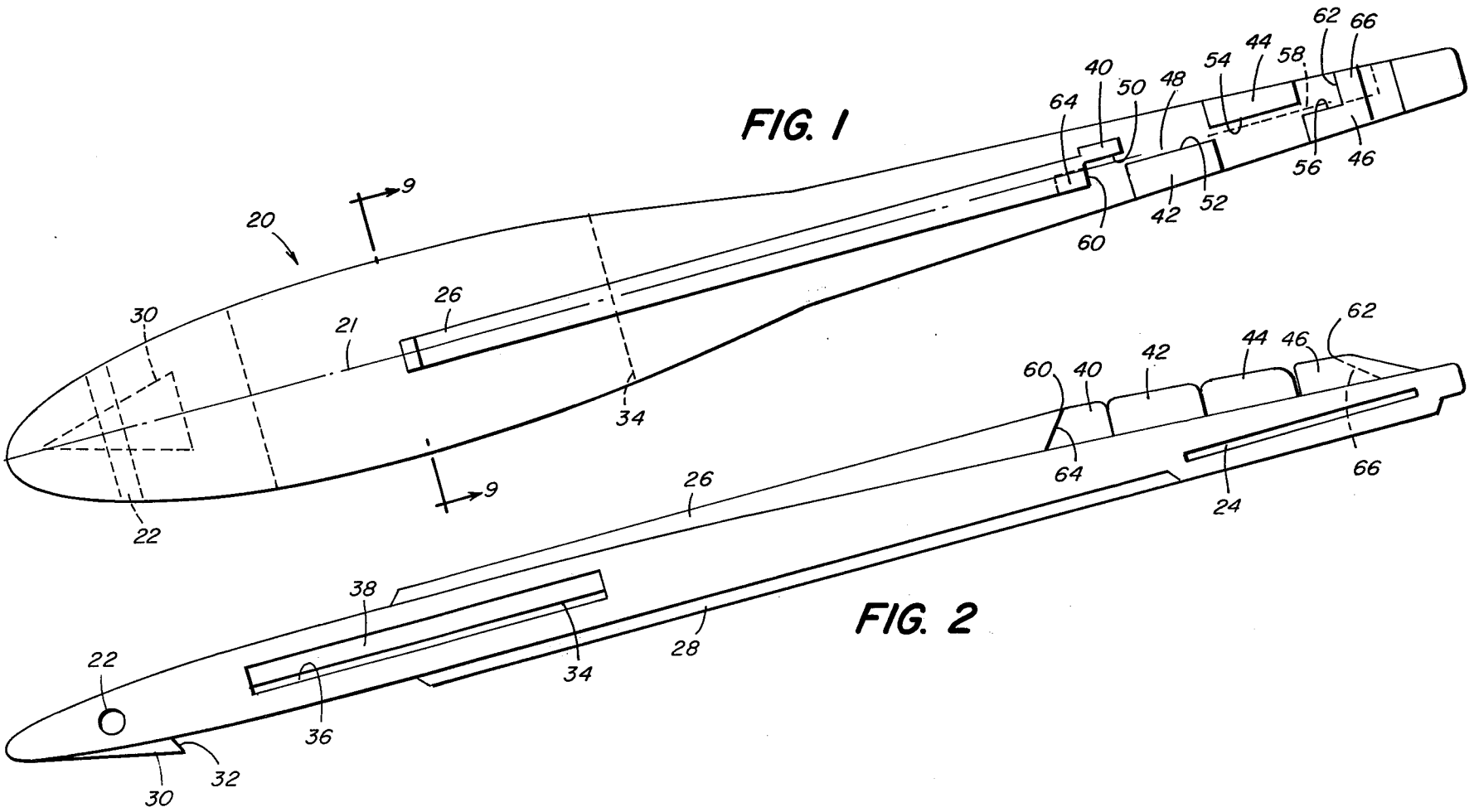
FIG. 1 is a plan view of a fuselage of a model airplane incorporating the invention.
FIG. 2 is an elevation view of the fuselage of FIG. 1.

Referring to FIGS. 1 and 2, there is shown a model airplane fuselage 20 made from expanded synthetic resinous material such as that sold under the trademark Styrofoam. It is of the conventional shape, with a major axis 21 running from front to back, and generally rounded and tapering to a smaller section at the rear. It is a three-dimensional object, providing an attractive, realistic model. Extending horizontally through the fuselage body 20 near the nose section is a circular cross-section nose weight hole 22. Also extending horizontally through the fuselage body, at the rear, is a stabilizer slot 24. Extending along the top surface of the illustrated fuselage, for about the last two-thirds of its length, is a top fin 26, which serves as a vertically projecting strengthening member. A corresponding bottom fin 28 extends along the bottom surface of the fuselage. A projection 30 from the bottom of the fuselage near the nose provides a launcher notch 32.

Figure 9:
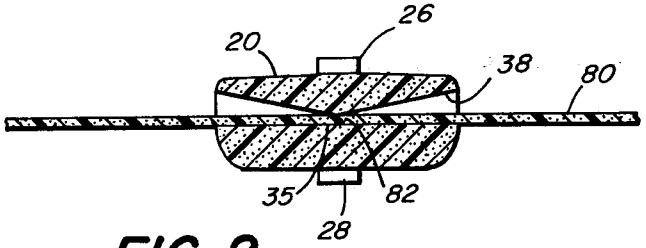
FIG. 9 is a cross-section view of the fuselage along the line 9—9 of FIG. 1 showing a wing seated in the wing slot.

A wing slot 34 extends horizontally through the fuselage 20. The wing slot 34 does not retain the same cross-section throughout. Rather, as shown in FIG. 9, it has a narrow portion at its centerline 35, which is located in the vertical plane passing through the fuselage major axis 21, a lower surface 36 that is horizontal, and an upper surface 38 with two symmetrical portions that incline upward at an angle, illustratively of about 12°, from the centerline 35 to the outside of the fuselage on each side. The nose weight hole 22, the stabilizer slot 24, and the wing slot 34 may all be formed during molding of the fuselage 20 by pins and fins extending inwardly from the walls of an aluminum cavity mold, in a conventional manner.

The fuselage 20 includes four vertical projections 40, 42, 44 and 46 rising in a linear series from the top rear surface of the fuselage to define a rudder slot 48. Projection 40 is, in the illustrated embodiment, the rearmost end of the top fin 26. Each projection 40, 42, 44 and 46 has a vertical wall surface 50, 52, 54, and 56, respectively, facing toward the center line 58 of the fuselage 20, and spaced a distance from it. In the embodiment shown, these surfaces are on alternate sides of the center line 58, and are spaced equal distances from the center line 58.

The forwardmost projection 40 and the rearmost projection 46 have edges 60 and 62, respectively, that are perpendicular to the fuselage center line 58 rather than parallel to it, and that define the front and rear of the rudder slot 48. Each projection 40 and 46 also includes an undercut portion, including surfaces 64 and 66, respectively, extending downwardly from edges 60 and 62. The intermediate projections 42 and 44 are generally tooth-like, free-standing, projections. None of the alternating projections 40, 42, 44 and 48 overlap, as viewed from the side of the fuselage 20 and this allows their formation in a mold that has simple horizontal extensions from the walls of the mold cavity, like those used to form the nose weight hole 22, the stabilizer slot 24, and the wing slot 34.

Figure 3:
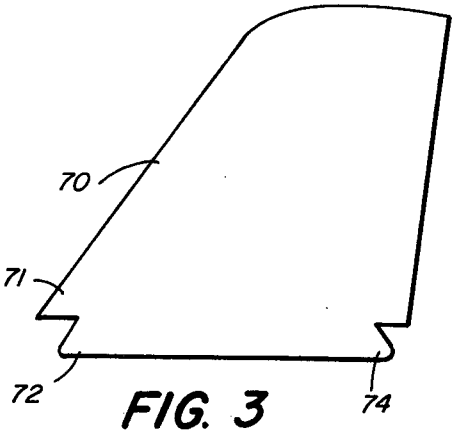
FIG. 3 is a plan view of a rudder for the airplane.

The rudder 70 is shown in FIG. 3. It is formed from a sheet of plastic material, preferably a lightweight plastic foam, that has some flexibility, at least at the front portion 71. The rudder 70 needs a certain amount of flexibility to allow its insertion into the rudder slot 58. The outline of the rudder 70 is conventional, except that it includes, at its front and rear bottom edges, a cut-out portion forming a projecting front triangular latching edge 72 and a similar projecting rear latching edge 74. Each latching edge conforms in shape to a corresponding surface 64, 66 of the undercut portions of the rudder projections 40 and 46.

Figure 7:
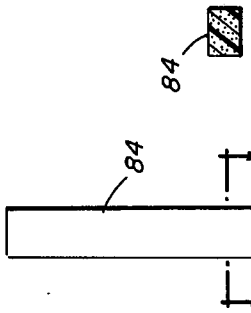
FIG. 7 is a plan view of a block used under the wing in assembling the airplane.
Figure 8:
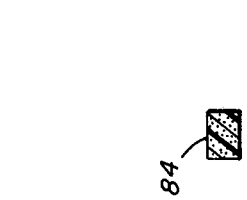
FIG. 8 is a cross-section view of the block of FIG. 7.
Figure 6:
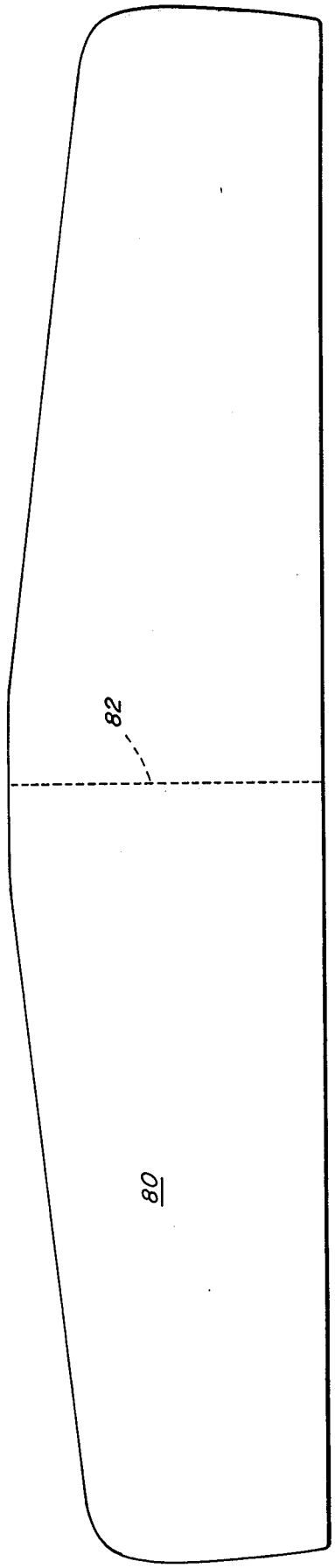
FIG. 6 is a plan view of a wing for the airplane.

The wing 80 for the airplane is shown in FIG. 6. It is made, like the rudder 70, from a lightweight, somewhat flexible, material, and is flexible at least across its center line 82. FIGS. 7 and 8 show wing wedges 84—blocks made of a plastic foam that are easily compressible. The illustrated blocks 84 have a rectangular cross-section, and are not as long as the width of the wing slot 34.

Figure 11:
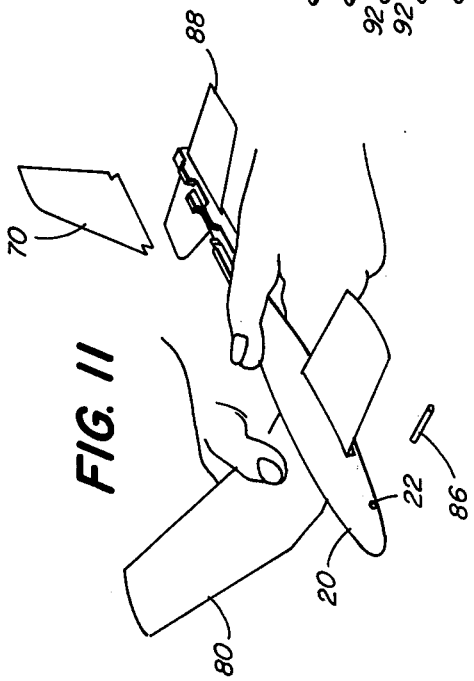
FIG. 11 illustrates generally the assembly of the airplane.

Other components of the airplane include the cylindrical metal nose weight 86 and the stabilizer 88, both indicated in FIG. 11.

The aircraft is assembled, from the flat, compactly packageable parts 20, 70, 80, and 88 and small parts 84 and 86, in the manner shown in FIG. 11. The nose weight 86 is inserted into the hole 22 in the nose of the fuselage 20, and the stabilizer 88 is inserted through the stabilizer slot 24 at the rear of the fuselage 20. The fit is tight enough so that friction retains these items in the fuselage, i.e. an interference fit.

Figure 4:
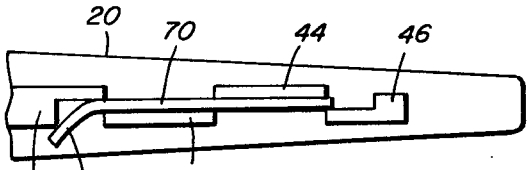
FIG. 4 is a fragmentary plan view of the rear of the fuselage showing a rudder partially inserted into the rudder slot.
Figure 5:
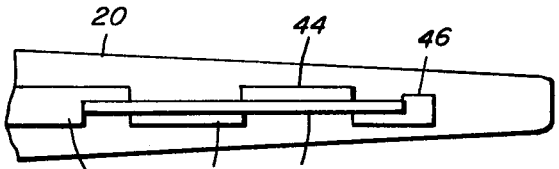
FIG. 5 is a view similar to FIG. 4, showing the rudder fully inserted.

The insertion of the rudder 70 is shown in greater detail in FIGS. 4 and 5. The rudder 70 may be slid into the rudder slot 78 from the front rather easily until most of it is in the slot as shown in FIG. 4. It then becomes necessary to bend the front portion 71 of the rudder 70 slightly to complete the insertion until the rudder 70 is fully inserted as shown in FIG. 5. The alternating projections 40, 42, 44 and 46 maintain the rudder 70 firmly in place. The triangular edges 72 and 74 at the base of the rudder 70 fit under the undercut portions of rudder projections 40 and 46 on the fuselage 20 to lock the rudder to the fuselage 20.

Figure 10:
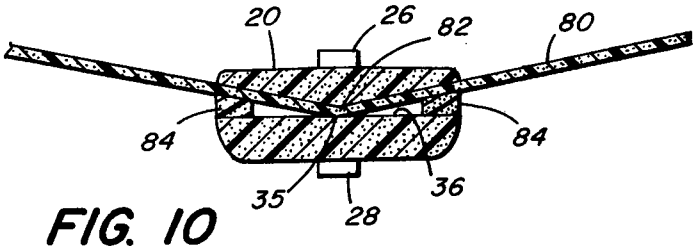
FIG. 10 is a view similar to FIG. 9 showing blocks inserted under the wing to provide the dihedral angle.

The wing 80 is inserted through the wing slot 34 in the fuselage 20 as shown in FIG. 11. The formation of the wing 80 into a dihedral shape is shown in greater detail in FIGS. 9 and 10. When the wing 80 is first inserted through the slot 34 it retains its generally flat orientation, as shown in FIG. 9. A block 84 is however pushed under each wing surface into the slot 34 on either side of the fuselage to offset the wing against the slot upper surfaces 38. The compressability of the block and the fuselage allow the block 84 to be squeezed in on each side, and the blocks 84 are kept in place by friction. The wing 80 takes on the desired dihedral shape by bending at its center line 82 so that the upper surface of the wing meets the upper surface 38 of the wing slot 34.

The assembled airplane is a glider that can be thrown by hand or a catapult can be used, with a flexible string or elastic member used around the launcher notch 32.

All of the necessary slots and receiving cavities in the fuselage as described can be formed by horizontally extending projections from the walls of the cavities of the mold, allowing the use of a simple, inexpensive draw mold.

Figure 12:
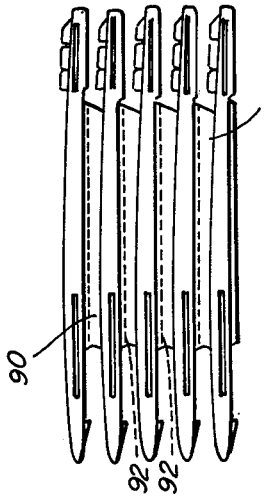
FIG. 12 is an elevation view of several fuselages joined together as they might come from a single mold.

Furthermore, several molds, or actually, a mold with several cavities in series, can be used to create "Siamese" fuselages like those shown in FIG. 12. This is a more efficient use of the molding process since it allows the creation of many fuselages in one step. The necessary integral connecting web 90 between the different bodies formed by the mold may be cut by a hot wire along lineal junctions 92. The cut leaves the top and bottom projections along most of the length of the fuselage that become the fins 26 and 28 of the fuselage 20. These are desirable strengthening members for the plane, particularly when the launching method for the plane is a catapult.

A particular embodiment being described, what is claimed as the invention is set forth in the following claims:

1. A model airplane fuselage molded from plastic foam comprising:

a main body with a major axis and a top surface having a center line and a rear portion, said body including a linear series of vertical projections rising from said rear top surface portion, in a nonoverlapping arrangement as viewed from the side of said fuselage, said projections having vertical wall surfaces spaced from said center line, at least one of said vertical wall surfaces being on one side of said center line and at least another of said vertical wall surfaces being on the other side, to form a rudder slot to receive a rudder.

2. The fuselage of claim 1 in which said vertical wall surfaces of said projections alternate on either side of said center line.

3. The fuselage of claim 1 or use with a rudder having a projecting edge and in which at least one of said projections includes an undercut portion having a surface for capturing said projecting edge.

4. The fuselage of claim 1 including a portion defining a horizontal slot for a wing, said slot extending through said fuselage perpendicularly to said main axis, and having a center line in the vertical plane passing through said major axis, said portion including a surface defining the upper portion of said slot, said surface including two symmetrical portions, each inclining upward from said slot center line toward the outer edge of said slot.

5. The fuselage of claim 4 including a wing flexible about its center line to be inserted in said wing slot and blocks to be inserted beneath said wing in said wing slot to offset said wing against said inclined surfaces, thereby to form a dihedral wing.

6. The fuselage of claim 1 including a linear fin-like projection extending along said center line of said top surface of said fuselage and a corresponding similar projection extending along the bottom surface of said fuselage.

7. The fuselage of claim 6 attached to at least one other fuselage by the continuation of one of said fin-like projections to integral joinder with one of said fin-like projections of said other fuselage.

8. A plastic foam model airplane including:

a fuselage comprising a main body with a major axis and a top surface having a center line and a rear portion, and a linear series of vertical projections rising from said rear top surface portion, in a non-overlapping arrangement as viewed from the side of said fuselage, said projections having vertical wall surfaces alternating on either side of said center line, and being spaced from said center line to form a rudder slot, a rudder having a projecting edge, at least one of said vertical projections including an undercut portion having a surface for capturing said rudder projecting edge, a wing bendable at its center line, and compressible blocks, said fuselage defining a horizontally extending wing slot perpendicular to said major axis and having a center line in the vertical plane passing through said major axis, including a surface defining the upper portion of said slot, said surface having two symmetrical portions, each inclining upward from said slot center line toward the outer edge of said slot, said wing slot insertably receiving said wing and insertably receiving said blocks beneath said wing to offset said wing against said inclined surfaces to form a dihedral wing.

* * * * *